US010480500B2

(12) United States Patent
Lee et al.

(10) Patent No.: US 10,480,500 B2
(45) Date of Patent: Nov. 19, 2019

(54) PUSHER PUMP RESISTANT TO CORROSION BY MOLTEN ALUMINUM AND HAVING AN IMPROVED FLOW PROFILE

(71) Applicant: ArcelorMittal, Luxembourg (LU)

(72) Inventors: Yong Lee, Munster, IN (US); James Costino, Munster, IN (US); Igor Komarovskiy, Schereville, IN (US)

(73) Assignee: ArcelorMittal, Luxembourg (LU)

( * ) Notice: Subject to any disclaimer, the term of this patent is extended or adjusted under 35 U.S.C. 154(b) by 37 days.

(21) Appl. No.: 14/556,205

(22) Filed: Nov. 30, 2014

(65) Prior Publication Data

US 2017/0198685 A1 Jul. 13, 2017

Related U.S. Application Data

(60) Provisional application No. 61/910,339, filed on Nov. 30, 2013.

(51) Int. Cl.
*F04B 43/00* (2006.01)
*F04B 53/16* (2006.01)
(Continued)

(52) U.S. Cl.
CPC ..... *F04B 43/0054* (2013.01); *C23C 2/003* (2013.01); *F04B 19/20* (2013.01);
(Continued)

(58) Field of Classification Search
CPC ..... F04B 43/02; F04B 43/0054; F04B 53/16; F27D 27/005; C23C 2/003
(Continued)

(56) References Cited

U.S. PATENT DOCUMENTS 3,606,291 A * 9/1971 Schneider ..... C21C 7/10 222/602
3,995,682 A * 12/1976 Fekete ..... B22D 41/50 164/437
(Continued)

FOREIGN PATENT DOCUMENTS

CN 2918407 Y 7/2007
CN 101439401 A 5/2009
(Continued)

*Primary Examiner* — Dominick L Plakkoottam
*Assistant Examiner* — Connor J Tremarche
(74) *Attorney, Agent, or Firm* — Davidson, Davidson & Kappel, LLC

(57) ABSTRACT

A bubble pump having a steel tube pump body having an interior formed from a ceramic material that resists attack by molten metal. The pump further has a nitrogen supply line attached to a lower portion of the pump body. The pump body and nitrogen supply line are covered with a ceramic cloth material that resists attack by molten metal. The pump also includes a discharge head attached to the top of the pump body. The discharge head is formed of a cast ceramic material that resists attack by molten metal and includes a distribution chamber therein which has an ellipsoidal dome shape with a generally flat bottom and an ellipsoidal top. The discharge head also includes two discharge nozzles which have a square cross section. These features provide the inventive pump with extended service life and reduced discharge turbulence of the molten metal.

9 Claims, 4 Drawing Sheets

(51) Int. Cl.

| | |
|---|---|
| ***F04B 43/02*** | (2006.01) |
| ***F27D 27/00*** | (2010.01) |
| ***C23C 2/00*** | (2006.01) |
| ***F04B 19/20*** | (2006.01) |
| ***F04B 43/08*** | (2006.01) |

(52) U.S. Cl.
CPC ..... *F04B 43/02* (2013.01); *F04B 43/08* (2013.01); *F04B 53/16* (2013.01); *F27D 27/005* (2013.01)

(58) Field of Classification Search
USPC ..... 417/109
See application file for complete search history.

(56) References Cited

U.S. PATENT DOCUMENTS

| | | | | | |
|---|---|---|---|---|---|
| 3,996,412 | A * | 12/1976 | Schaefer | F27B 3/08 | 373/128 |
| 4,480,793 | A * | 11/1984 | Grande | B05B 1/02 | 239/567 |
| 4,590,988 | A | 5/1986 | Fukuoka et al. | | |
| 5,632,324 | A * | 5/1997 | Nara | B22D 11/115 | 164/466 |
| 5,650,120 | A | 7/1997 | Morando | | |
| 5,709,474 | A * | 1/1998 | Richardson | G01K 1/105 | 136/234 |
| 5,863,314 | A * | 1/1999 | Morando | B01F 3/04248 | 266/228 |
| 5,871,660 | A * | 2/1999 | Xu | B22D 41/50 | 222/594 |
| 6,378,743 | B1 * | 4/2002 | Kagan | B22D 11/064 | 222/590 |
| 6,613,118 | B2 * | 9/2003 | Eckert | C22B 9/00 | 75/10.65 |
| 6,817,550 | B2 * | 11/2004 | Taylor | B05B 1/00 | 239/19 |
| 6,846,221 | B2 * | 1/2005 | Ulrich | B24C 5/04 | 451/102 |
| 2004/0115079 | A1 | 6/2004 | Cooper | | |
| 2005/0204866 | A1 | 9/2005 | Morando | | |
| 2009/0126893 | A1 | 5/2009 | Huang et al. | | |
| 2015/0104333 | A1 | 4/2015 | Lee et al. | | |

FOREIGN PATENT DOCUMENTS

| | | | |
|---|---|---|---|
| CN | 101890285 | A | 11/2010 |
| CN | 101988614 | A | 3/2011 |
| JP | S53103206 | A | 9/1978 |
| JP | S61218800 | A | 9/1986 |
| JP | H07166309 | A | 6/1995 |
| JP | H10277726 | A | 10/1998 |
| JP | H11152553 | A | 6/1999 |
| JP | 2000119834 | A | 4/2000 |
| JP | 2010196557 | A | 9/2010 |
| JP | 2011168832 | A | 9/2011 |
| RU | 9448 | U1 | 3/1999 |
| SU | 1575043 | A1 | 6/1990 |
| WO | 2013155497 | A1 | 10/2013 |

* cited by examiner

PUSHER PUMP RESISTANT TO CORROSION BY MOLTEN ALUMINUM AND HAVING AN IMPROVED FLOW PROFILE

FIELD OF THE INVENTION

The present invention relates to apparatus for the coating of molten metal onto steel. More specifically it relates to bubble pumps used in molten metal baths to remove surface dross from the molten metal in the vicinity of the steel strip being coated. Most specifically it relates to protection of the interior of such bubble pumps from attach attack and destruction by the molten metal.

BACKGROUND OF THE INVENTION

Molten metals (aluminum, zinc, or their mixture) are commonly used as a protective coating on the surface of steel, particularly steel sheet material. A clean interface between the steel surface and the molten metal in a hop-dip melting pot is a very important component to achieving good coating adhesion. One of the steps taken to insure a clean interface is by using pumps to supply fresh molten metal inside the snout in the vicinity of the region where initial contact of the steel strip with the melt takes place. The pumps push floating dross and oxide particles out of the vicinity of the strip surface, and finally remove them out of the melt/snout. This is known as a push-pull snout pump system. In aluminizing melts, molten aluminum corrosion is so severe that impeller type mechanical pumps cannot operate due to dissolution of the impeller. Only pneumatic driven pumps can survive in this corrosive environment. However, regular pusher pumps made from carbon steel generally only survive this environment for 24 hours or less under constant operation. The pumps typically develop holes in the discharge heads thereof. When a dross moving pump breaks down, it must be changed during the production run. This leads to disruption in production and contamination of molten metal surface. Additionally, current pusher pumps show excessive spitting at the discharge nozzle, especially when it is corroded. This spitting is spattering of the molten metal due to nitrogen bubbles and excessive turbulent flow. This leads to the formation of solidified metal buildup inside the snout. This buildup has routinely been a serious maintenance issue. Therefore, a pusher pump with extended service life and reduced discharge turbulence is needed in the art to increase the coating line production/yield and decrease down time. To this end, the present inventors have developed a novel molten metal pusher pump that is resistant to corrosion by molten aluminum and has an improved flow profile.

SUMMARY OF THE INVENTION

The present invention is a bubble pump which may have a pump body comprising a vertical steel tube configured to allow for the transport of molten metal there through. The pump body may have an interior formed from a material that resists attack by molten metal. The bubble pump may further include a nitrogen supply line which may be attached to a lower portion of the pump body. The nitrogen supply line and said pump body may communicate so as to allow the flow of nitrogen from the nitrogen supply line into the interior of the pump body. Finally, the bubble pump may include a discharge head attached to the top of said pump body. The discharge head may communicate with the pump body so as to allow for transport of molten metal and nitrogen from the pump body, into and then out of the discharge head. The material that resists attack by molten metal may be selected from the group consisting of alumina, magnesia, silicate, silicon carbide, graphite, and the mixtures of these ceramic materials.

The pump body may be wrapped in one or more layers of ceramic cloth to provide the exterior of said pump body with flexible resistance to attack by molten metal. The nitrogen supply line may also be wrapped in one or more layers of ceramic cloth to provide the exterior of said pump body with flexible resistance to attack by molten metal. The ceramic cloth may be formed of a material that resists attack by molten metal which may be selected from the group consisting of alumina, magnesia, silicate, silicon carbide, graphite, and the mixtures of these ceramic materials.

The discharge head may be formed of a cast ceramic material that resists attack by molten metal which may be selected from the group consisting of alumina, magnesia, silicate, silicon carbide, graphite, and the mixtures of these ceramic materials. The discharge head may contain a distribution chamber therein. The distribution chamber may be in communication with the pump body to allow for the flow of molten metal and nitrogen from the pump body through the distribution chamber. The distribution chamber may have an ellipsoidal dome shape with a generally flat bottom and an ellipsoidal top. The discharge head may further contain two discharge nozzles which may be in communication with the distribution chamber to allow for the flow of molten metal and nitrogen from the distribution chamber through the discharge nozzles and out of the bubble pump. The discharge nozzles may have a square cross section.

DETAILED DESCRIPTION OF THE INVENTION

Gas lift or Bubble pumps use the artificial lift technique of raising a fluid such as water, oil or even molten metal by introducing bubbles of compressed air, water vapor, nitrogen, etc. into the outlet tube. This has the effect of reducing the hydrostatic pressure in the outlet of the tube vs. the hydrostatic pressure at the inlet side of the tube. The present inventors have sought to improve the pump performance as far as providing more directed melt flow and eliminating the spitting issue, and also significantly increasing the service life of the pumps. Changes in pump design and the incorporation of a cast refractory lining are key factors in the improved inventive pusher pump.

Figure 1:
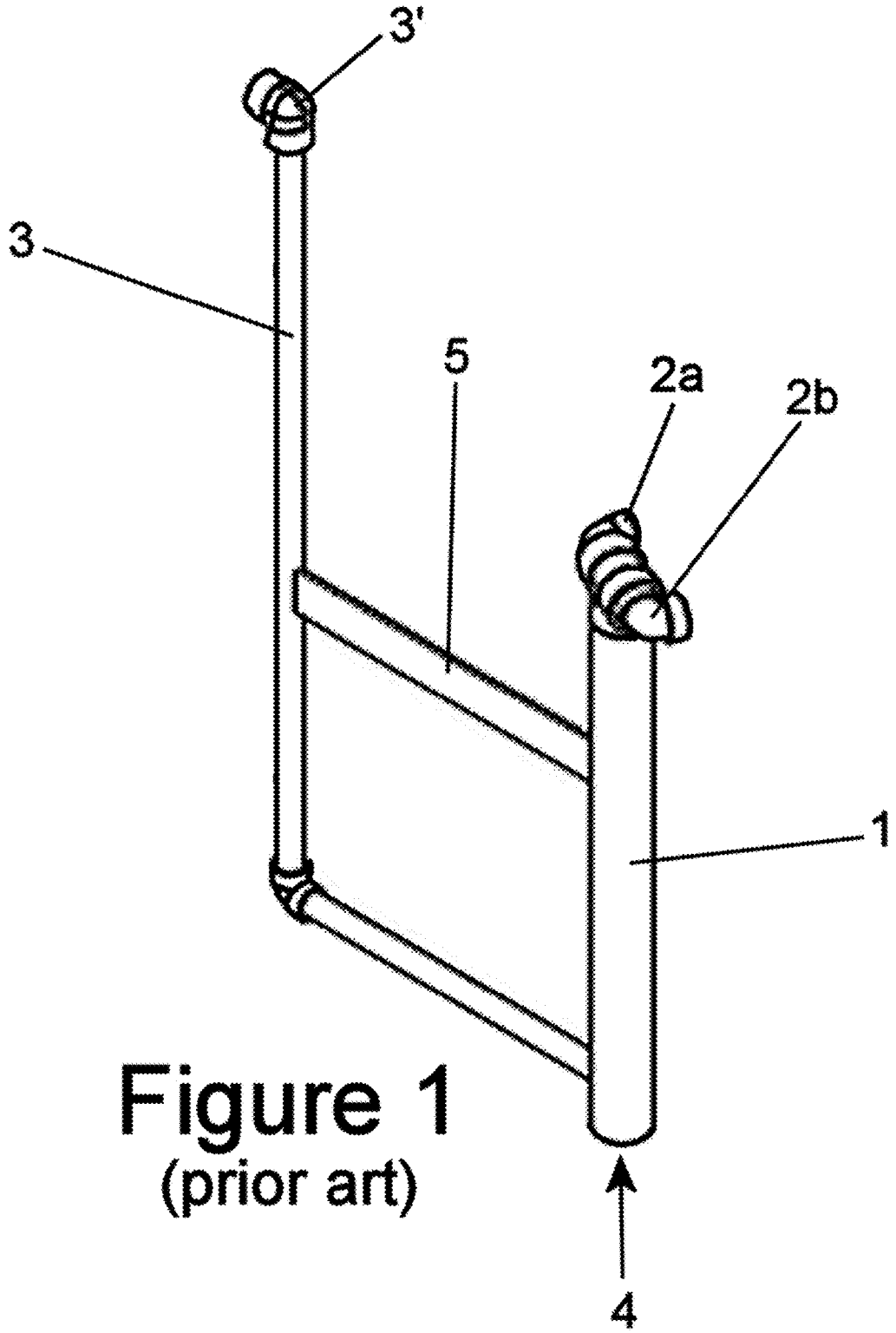
Figure 1 (prior art)
FIG. 1 is a depiction of the prior art pusher pump.

FIG. 1 is a depiction of the prior art pusher pump. The pump includes a pump body 1 which consists of a carbon steel pipe or tube. The pump also includes outflow nozzles 2*a*, 2*b*. There is a nitrogen supply line 3 which supplies nitrogen bubbles to the pump body 1. A support bar 5 is connected to the nitrogen supply line 3 and pump body 1. The nitrogen supply line 3 has a connector 3' which attached to the external supply of nitrogen. In operation the nitrogen bubbles rise in pump body 1, causing an upward flow of molten metal. The molten metal enters the open bottom 4 of the tubular pump body and is ejected from outflow nozzles 2*a*, 2*b*. Since the molten metal is taken from below the surface of the melt, it does not contain floating dross and other contaminants. The two nozzles 2*a*, 2*b* direct clean fresh metal to either side of the steel sheet as it is passed through the metal bath and thereby coated.

This prior art pump is subject to corrosion and deterioration in the molten metal, particularly where the metal is agitated by bubbling nitrogen and flow eddies. These prior art pusher pumps, made from carbon steel, last only up to 24 hours of constant operation and develop holes in the discharge head. Changing dross moving pumps during the production run leads to disruption in production and contamination of molten metal surface.

Figure 2:
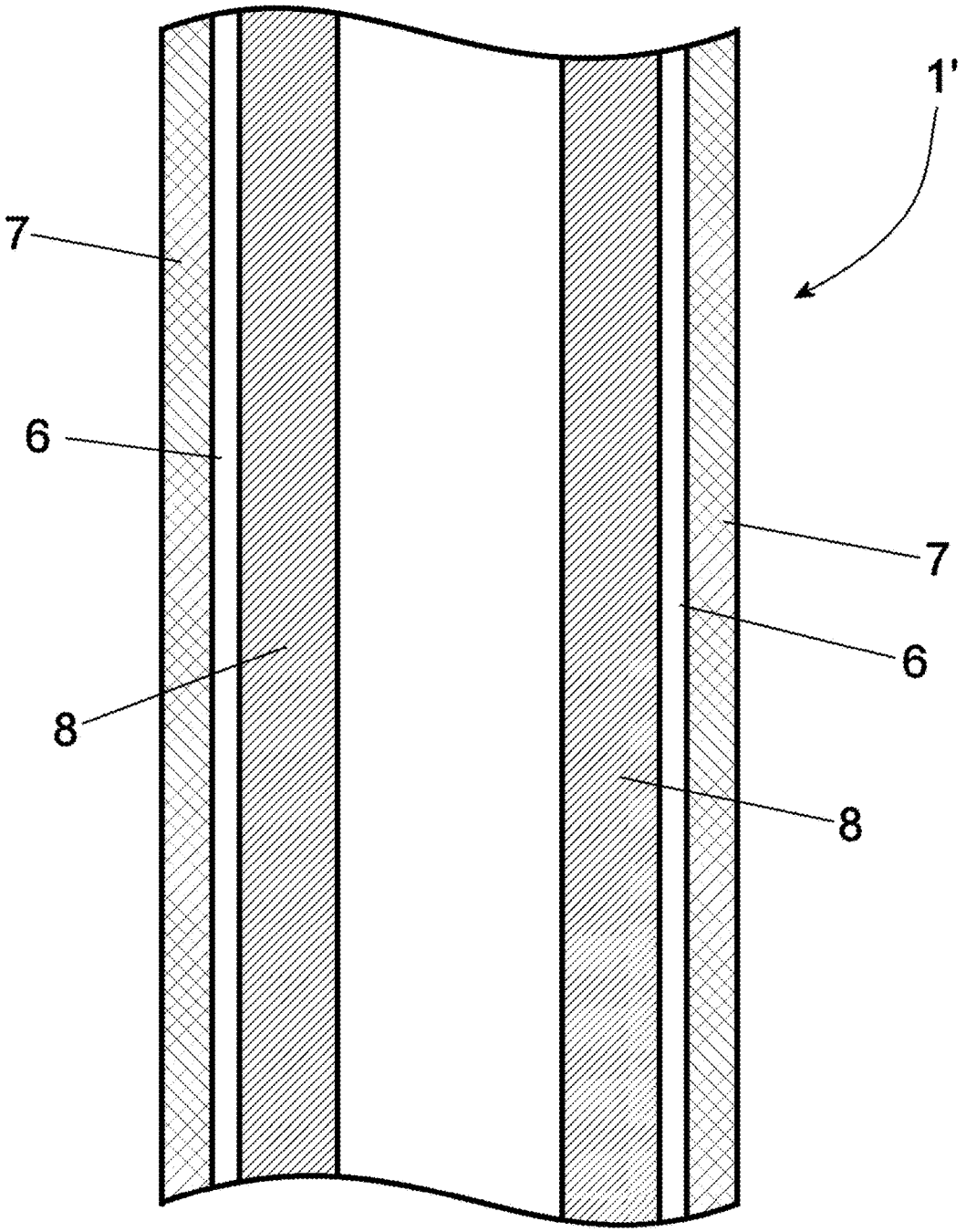
FIG. 2 is a depiction of a cross section of an embodiment of the inventive pump body.

To combat this corrosion and deterioration, the present inventors have formed an in-situ cast ceramic liner inside the inventive pump body. FIG. 2 is a depiction of a cross section of the inventive pump body 1'. The inner cast layer 8 is formed of a ceramic material that is non-wetting to molten metal and can withstand the temperatures of the molten metal. The material is cast on the interior of a carbon steel shell tube 6. The protective inner cast layer lining 8 is preferably made of materials selected from the group consisting of alumina, magnesia, silicate, silicon carbide, graphite, and the mixtures of these ceramic materials.

Further, the outside of the carbon steel tube 6 is covered with a flexible ceramic cloth wrap 7 to extend life of the steel. The wrap 7 is superior to the standard ceramic lining outside the steel because it does not crack during use. It should be noted that the nitrogen supply tube is formed of carbon steel and is also covered in the wrap 7. Further, any steel support brackets should also be covered in the wrap 7.

Figure 3:
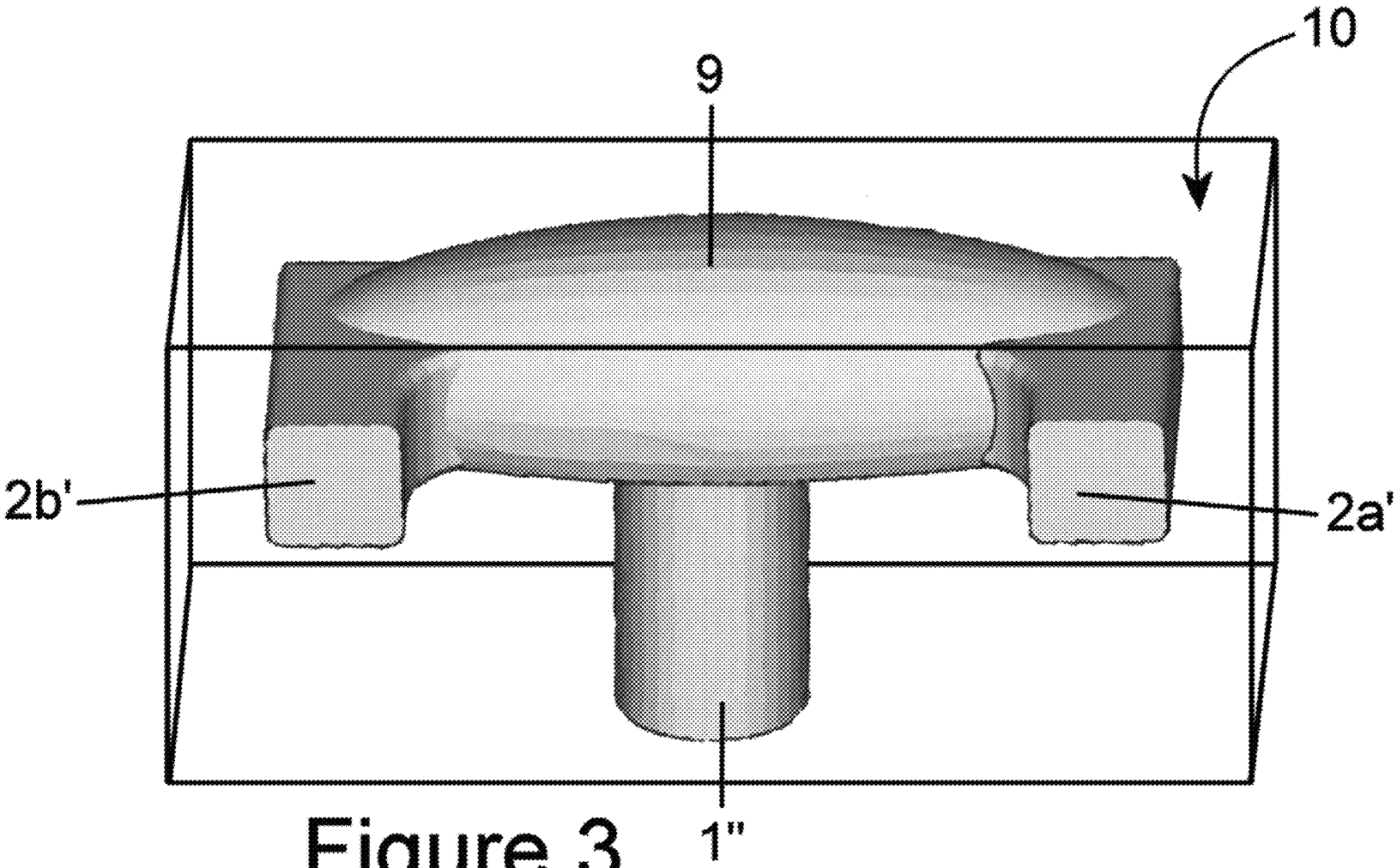
FIG. 3 is a depiction of an embodiment of the preferred discharge head for the inventive pump.

In addition to improved corrosion resistance from the cast ceramic liner 8 and the ceramic wrap 7, the inventive bubble pump has improved flow characteristic over the prior art pump. FIG. 3 is a depiction of the preferred discharge head 10 for the inventive pump 1". The head 10 is cast from the same class of ceramic material that is non-wetting to molten metal and can withstand the temperatures of the molten metal. It can be the same material as that in the ceramic liner of the pump body, or may be a different material if conditions make this advantageous. Further, it may be advantageous in some instances to cast metal support structures within the ceramic head 10 to provide enhanced mechanical strength and durability. It should be noted that the shape within the block of ceramic is actually the open hollow area shape cast into the block for fluid flow.

Within the head is a distribution chamber 9 having an ellipsoidal dome shape with a generally flat bottom and an ellipsoidal top. This extended internal dome concept was introduced to accommodate the gas volume expansion and provide higher and more stable discharge flow than the prior art carbon steel pusher pump. Also cast into the discharge head 10 are two discharge outlets 2*a*', 2*b*'. The square discharge nozzle design was introduced to provide more laminar discharge without spitting. As can be seen in FIG. 1, the prior art conventional discharge design has round nozzles 2*a*, 2*b*. The efficiency of square nozzles 2*a*', 2*b*' was evaluated initially by water modeling, and then plant trials confirmed that this design provided much more directed melt flow and eliminated the spitting issues of the prior art.

Figure 4:
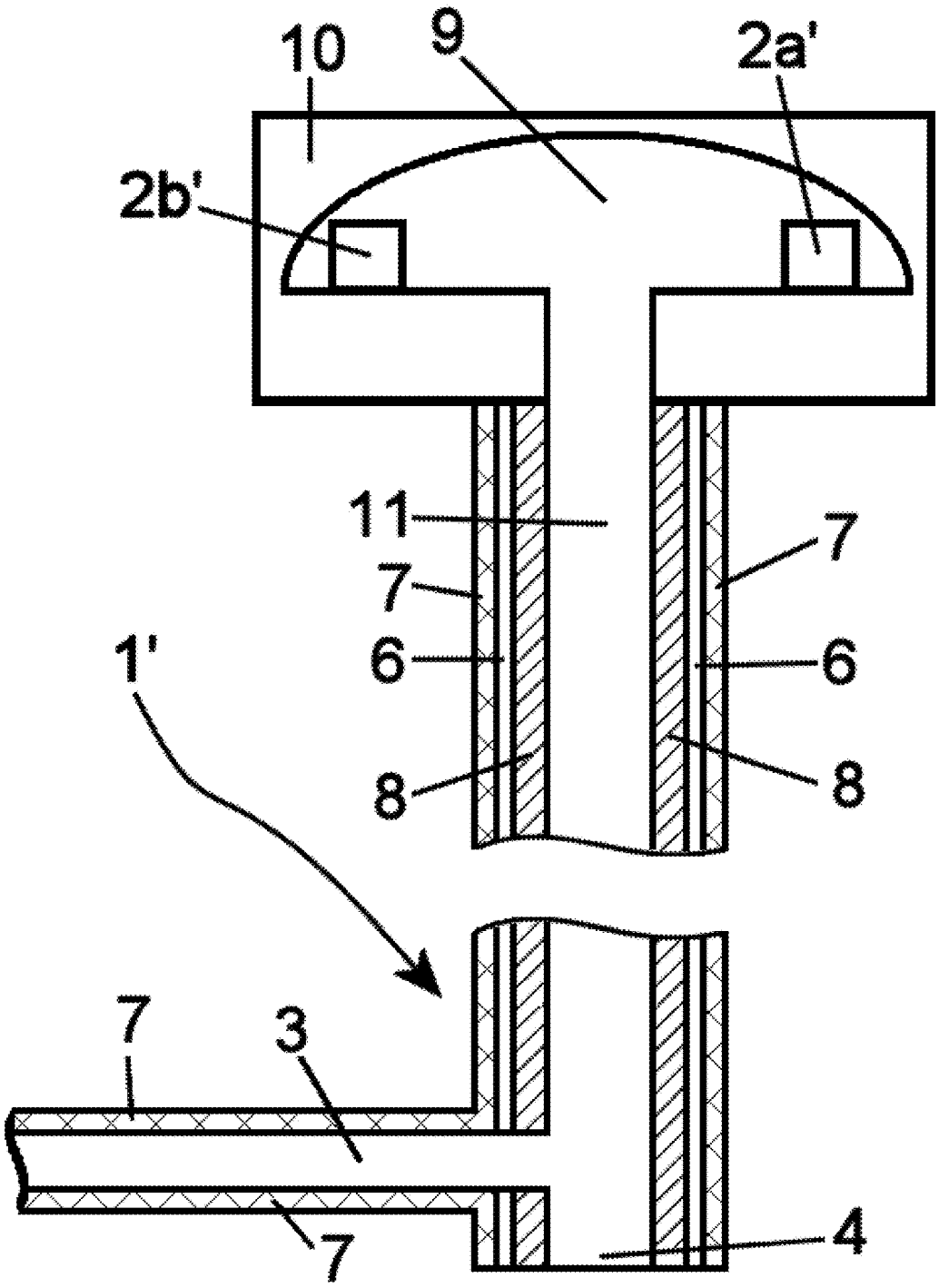
FIG. 4 is a depiction (not to scale) of a cross section of a preferred embodiment of a pump of the instant invention.

Finally, FIG. 4 is a depiction (not to scale) of a cross section of a pump of the instant invention. Specifically shown are all of the inventive features of the present invention. First there is an interior 11 surrounded by the cast ceramic liner 8 within the carbon steel shell tube 6 of the pump body 1'. Then there is the external ceramic cloth 7 wrapping the carbon steel shell tube 6 of the pump body 1' and the carbon steel nitrogen supply line 3. Next there is the cast ceramic discharge head 10 which incorporates the inventive distribution chamber 9 which has an ellipsoidal dome shape with a generally flat bottom and an ellipsoidal top. Finally there are the square discharge nozzles 2*a*', 2*b*' introduced to provide more laminar discharge without spitting.

All of these inventive features provide the inventive pump with extended service life between failures of the pusher pump and reduced discharge turbulence in the molten metal.

We claim:

1. A bubble pump having:

a pump body comprising a vertical steel tube configured to allow for the transport of molten metal there through; said pump body having an interior formed from a non-wetting ceramic material cast on a carbon steel tube, the ceramic material being resistant to attack by molten metal; a nitrogen supply line attached to a lower portion of said pump body; said nitrogen supply line and said pump body communicating so as to allow the flow of nitrogen from said nitrogen supply line into the interior of said pump body; and a discharge head attached to the top of said pump body; said discharge head communicating with said pump body so as to allow for transport of molten metal and nitrogen from said pump body, into and then out of said discharge head; wherein said distribution chamber has an ellipsoidal dome shape with a generally flat bottom and an ellipsoidal top; wherein the ellipsoidal dome shape has a horizontal extent and a vertical extent, the horizontal extent being greater than the vertical extent, said discharge head further contains two discharge nozzles in communication with said distribution chamber to allow for the flow of molten metal and nitrogen from said distribution chamber through said discharge nozzles and out of said bubble pump.

2. The bubble pump of claim 1, wherein said ceramic material that resists attack by molten metal is selected from the group consisting of alumina, magnesia, silicate, silicon carbide, graphite, and the mixtures of these ceramic materials.

3. The bubble pump of claim 1, wherein said pump body is wrapped in one or more layers of ceramic cloth to provide the exterior of said pump body with flexible resistance to attack by molten metal.

4. The bubble pump of claim 3, wherein said nitrogen supply line is also wrapped in one or more layers of ceramic cloth to provide the exterior of said pump body with flexible resistance to attack by molten metal.

5. The bubble pump of claim 4, wherein said ceramic cloth is formed of a material that resists attack by molten metal selected from the group consisting of alumina, magnesia, silicate, silicon carbide, graphite, and the mixtures of these ceramic materials.

6. The bubble pump of claim 1, wherein said discharge head is formed of a cast ceramic material that resists attack by molten metal.

7. The bubble pump of claim 6, wherein said cast ceramic material that resists attack by molten metal is selected from the group consisting of alumina, magnesia, silicate, silicon carbide, graphite, and the mixtures of these ceramic materials.

8. The bubble pump of claim 1, wherein said discharge head contains said distribution chamber therein, said distribution chamber in communication with said pump body to allow for the flow of molten metal and nitrogen from said pump body through said distribution chamber.

9. The bubble pump of claim 1, wherein discharge nozzles are located adjacent opposite ends of the horizontal extent and have a square cross section.

* * * * *